United States Patent [19]

Cortinovis

[11] Patent Number: 4,825,679

[45] Date of Patent: May 2, 1989

[54] FIXING CLAMP FOR STRAIGHTENING THE BODYWORK OF ACCIDENT-DAMAGED AUTOMOBILES, AND IN PARTICULAR THE SHEET METAL SEATS FOR MACPHERSON SUSPENSION HEADS

[75] Inventor: Paolo Cortinovis, Villa Di Serio, Italy

[73] Assignee: Linea A S.r.l., Bergamo, Italy

[21] Appl. No.: 73,753

[22] Filed: Jul. 13, 1987

[30] Foreign Application Priority Data

Jul. 16, 1986 [IT] Italy ..... 2923 A/86

[51] Int. Cl.[4] ..... B21D 1/12

[52] U.S. Cl. ..... 72/308; 72/705

[58] Field of Search ..... 269/52; 72/308, 705, 72/704, 422

[56] References Cited

U.S. PATENT DOCUMENTS 3,112,116 11/1963 Seitz ..... 269/52

4,296,626 10/1981 Jarman et al. ..... 72/705

4,309,894 1/1982 Connor ..... 72/705

FOREIGN PATENT DOCUMENTS 0197229 10/1986 European Pat. Off. .

8610367 4/1986 Fed. Rep. of Germany .

*Primary Examiner*—Lowell A. Larson

*Attorney, Agent, or Firm*—Ladas & Parry

[57] ABSTRACT

This fixing clamp for straightening the bodywork of accident-damaged automobiles, and in particular the sheet metal seats for MacPherson suspension heads, is characterized by a pin provided with threaded axial end bores for receiving eyebolts, and with an intermediate step on which there rests a flange for supporting the sheet metal which is to be repositioned and/or straightened and which comprises a hole through which the pin shank is passed, a further drilled flange then being mounted on the pin, and being clamped against the sheet metal to be straightened by the pressure exerted by a sleeve which carries a positionable transverse fixing clip and is tightened by a nut screwed onto the pin.

11 Claims, 1 Drawing Sheet

Figure 1:
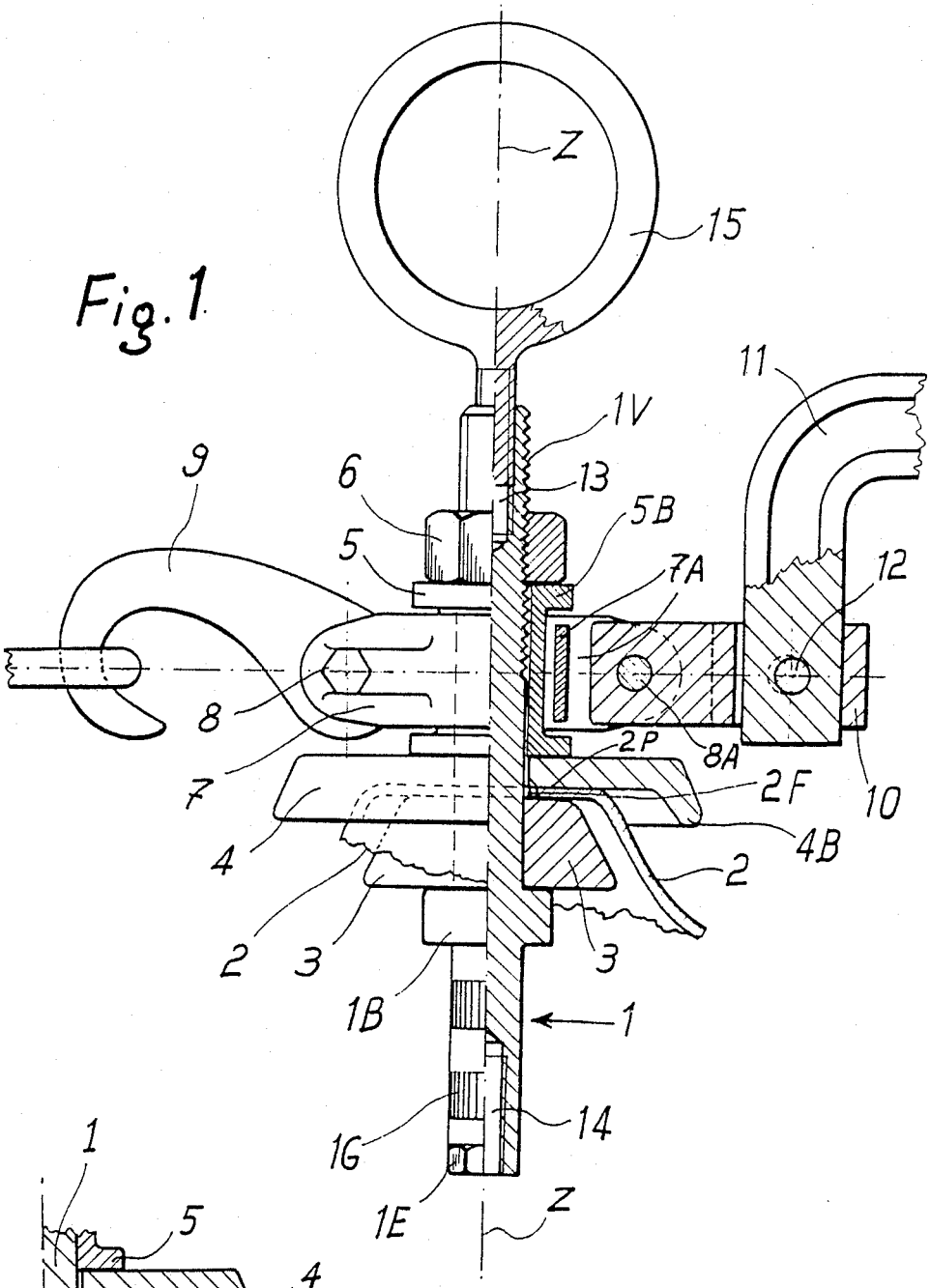

FIXING CLAMP FOR STRAIGHTENING THE BODYWORK OF ACCIDENT-DAMAGED AUTOMOBILES, AND IN PARTICULAR THE SHEET METAL SETAS FOR MACPHERSON SUSPENSION HEADS

This invention relates to the field of tools for straightening sheet metal parts of motor vehicles deformed by impact resulting from road accidents.

As is well known, automobiles are very costly while at the same time being very delicate structurally. If they are involved in a road accident, such automobiles suffer permanent deformation of their body and load-bearing structure by virtue of their box-formed sheet steel construction. Because of their high cost, accident-damaged automobiles require their owner to choose between scrapping them and purchasing a new one, or having them repaired in specialised body shops. The choice depends on the expense of such a repair, which is a function of the work and time involved in the repair by the body shop.

If the damaged body part has a mainly aesthetic purpose, or if the part can be easily replaced with a suitably fitted spare, the repair costs are relatively low. However if the deformation undergone by the automobile body involves its load-bearing structure or the suspension connections, the repair becomes much more delicate as the road-holding of the vehicle depends on the relative spatial position of the connections.

This is particularly true in the case of MacPherson suspensions. This type of suspension is considerably widespread because of its undoubted advantages, which derive from the fact that it is based on only three points of fixing to the body. This represents a cost advantage for the automobile manufacturer and for the purchaser, but constitutes a disadvantage for an owner if the body deformation involves these three characteristic suspension fixing points.

The disadvantage is even greater if the suspension concerned is the front suspension, because in this case the steering rotation about the shock absorber axis involves the castor angle, camber angle and slip angle, which are related to each other by precise optimum ratios for each working condition. In such an event, the exact spatial positions of the connections must be rigorously respected, otherwise the automobile cannot be driven correctly, and is therefore dangerous.

The restoration of the geometry of the automobile forecarriage (or rear axle) is currently done using improvised and therefore non-specific tools which on the one hand result in longer and more costly work, and on the other hand do not allow rigorously correct restoration to be attained. One tool already available commercially for such restoration work comprises a flange or plate to be fixed over the seating cap for the spring head by means of bolts inserted through the holes normally provided for fixing these heads.

As these holes are of small diameter and of limited number because of their anti-rotation and anti-separation function under hypothetical suspension resonance conditions, they allow only very small forces to be applied for rebending the body, especially if the work has to be carried out under flexural conditions induced by distance pieces which have been inserted so as not to deform the edges of the hole, indicated by 2F.

In addition to resulting in incorrect rebending of the sheet metal, this tool is not suitable for all "heads", as the distance between the hole axes changes from one type of automobile to another, and the use of radial slots is not always sufficient or suitable. In this respect, not only does the diameter of the circle on which these holes are disposed change, but also the angle between them, so that they may not mate with those set by the radial slots.

The use of specific plates for each type of automobile would result in an excessive purchase price for this tool by body shops, who could then be forced to renounce the use of such a tool and use instead improvised systems to the detriment of safety for the road user, who could become the victim of an improperly repaired third-party automobile.

This is not only because of the suspension geometry aspect, but also because of the possibility of deformation or fracture arising from incorrect or excessive force used during the straightening of the body sheet metal.

Moreover, new methods are currently being introduced for fixing MacPherson suspension heads which dispense with the need for those holes required by this flat tool, so that it is becoming further limited in its application.

An object of the present invention is to provide a tool which eliminates the need for improvised body repair methods using inadequate tools which besides being costly by virtue of the time required, do not allow precise restoration of the connection geometry.

A further object is to offer to the body shop market a tool which is practical to use, reduces repair times and at the same time allows high-precision work.

A further object is to propose a tool which can be used on as large a number of automobiles as possible, independently of the method used for connecting the MacPherson suspension head. A further object is to provide a very strong tool which is still perfectly operable even after intense long-term usage.

This and further objects of the invention will be apparent to experts of the art on reading the description and claims given hereinafter.

The fixing clamp for straightening the bodywork of accident-damaged automobiles, and in particular the sheet metal seats for MacPherson suspension heads, is characterised by a pin provided with threaded axial bores at its ends for receiving eyebolts, and with an intermediate step on which there rests a flange for supporting the sheet metal which is to be repositioned and/or straightened and which comprises a hole through which the pin shank is passed, a further flange then being mounted on the pin, and being clamped against the sheet metal to be repositioned and/or straightened by the pressure exerted by a sleeve which carries a positionable transverse fixing clip and is tightened by a nut screwed onto the pin.

Figure 2:
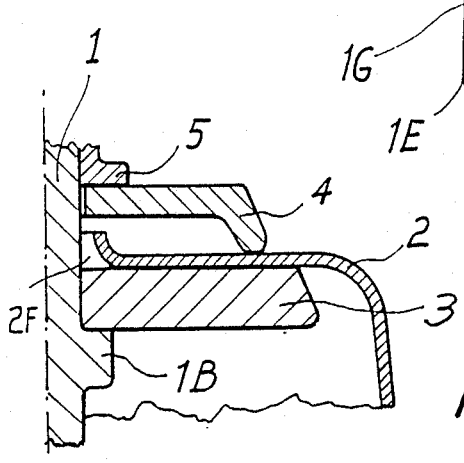

The invention is shown by way of non-limiting example in FIG. 1 of the accompanying drawing, which shows the tool half in full view and half in section in its operating position. FIG. 2 is a detailed view of a further clamping method for use when the edge of the holes 2F is to be protected.

With reference to the aforesaid figures, a central pin 1 with a shoulder 1B is inserted through a hole 2F in the cap 2 which is provided in the sheet metal body and is to be displaced into a different relative spatial position. The cap 2 could be that which is provided for housing and fixing the MacPherson suspension head or the upper support plate for the relative helical spring (not shown).

A heavy conical flange 3 with rounded edges is rested on the shoulder 1B and is inserted into the concave space of the cap 2 so that it rests thereagainst with the largest possible surface area. For this purpose, the tool is provided with a series of flanges 3 of different diameters to suit the seating caps in all types of automobile. The unit 1, 3 is inserted through the hole 2F so that the flat region 2P becomes clamped by a further flange 4 thrust by a sleeve 5 which is tightened down by a nut 6 screwed onto the thread 1V of the central pin 1. The flange 4 is shown with a rim 4B, but this represents an accessory and is useful only in particular situations (such as that shown in FIG. 2), so that it could equally perform its function by comprising only simple parallel faces. The purpose of the tool is to utilise mainly the friction which the two flanges 3 and 4 exert on the sheet metal by virtue of their flat surfaces.

Two U-shaped clips 7 and 7A are mounted on the sleeve 5 and are connected together by two bolts 8 and 8A. These clips are limited in their axial sliding by the rims 5B of the sleeve 5, but can rotate about the main axis Z for positioning in the direction of traction required for straightening purposes. The purpose of the connected clips 7, 7A is to offer a method of fixing the traction-applying means by the bolts 8 and 8A. For this purpose, the bolts can be used for fixing either a hook 9, or a square-holed connection piece 10 for connection to a hook arm 11 to form a bridge above the body if this is in danger of being damaged by the cables or chains used for traction purposes. This arm is fixed to the connection piece 10 by a normal safety bolt 12. The ends of the pin 1 are provided with threaded axial bores 13 and 14 to allow the screwing-in of eyebolts 15 used for exerting traction in a mainly axial upward and downward direction.

From the aforegoing description it is apparent that the tool is not only able to be firmly fixed to the sheet metal to be "displaced", but also allows traction to be applied in any direction by a combination of axial forces 15 with radial forces 9, 10 generated by usual chains and suitable traction-application means (hydraulic or mechanical). The lower end (with reference to the drawing) of the pin 1 is provided with knurling 1G to facilitate both non-slip handling and the tightening of the nut 6. To prevent any rotation of the pin 1 about itself during the tightening of the nut 6, the end of the pin 1 is in the shape of a right hexagonal prism 1E for engagement with normal hexagonal spanners.

I claim:

1. A fixing clamp for straightening the bodywork of accident-damaged automobiles, and in particular the sheet metal seats for MacPherson suspension heads, characterised by a pin (1) provided with threaded axial bores (13, 14) for receiving eyebolts (15), and with an intermediate step (1B) on which there rests a flange (3) for supporting the sheet metal (2) which is to be repositioned and/or straightened and which comprises a hole (2F) through which the shank of the pin (1) is passed, a further drilled flange (4) then being mounted on the pin (1), and being clamped against the sheet metal to be repositioned and/or straightened by the pressure exerted by a sleeve (5) which carries a positionable transverse fixing clip (7, 7A) and is tightened by a nut (6) screwed onto the pin.

2. A fixing clamp as claimed in claim 1, characterised in that the drilled flange is provided with an outer circumferential rim which is clamped against the first mentioned flange by way of the sheet metal without affecting the edges of the hole which is present in the sheet metal to be repositioned.

3. A fixing clamp as claimed in the preceding claim, characterised in that one end of the pin (1) is provided with at least one knurled band.

4. A fixing clamp as claimed in claim 3, characterized in that one end of the pin (1) is shaped as a right hexagonal prism (1E) for engagement by normal hexagonal spanners.

5. A fixing clamp as claimed in claim 3, characterised in that the drilled flange is provided with an outer circumferential rim which is clamped against the first mentioned flange by way of the sheet metal without affecting the edges of the hole which is present in the sheet metal to be repositioned.

6. A fixing clamp as claimed in claim 1, characterised in that one end of the pin (1) is shaped as a right hexagonal prism (1E) for engagement by normal hexagonal spanners.

7. A fixing clamp as claimed in claim 6, characterised in that the drilled flange is provided with an outer circumferential rim which is clamped against the first mentioned flange by way of the sheet metal without affecting the edges of the hole which is present in the sheet metal to be repositioned.

8. A tool for straightening the bodywork of a damaged vehicle, and in particular the sheet metal seats for MacPherson suspension heads, the tool comprising:

(a) a pin provided with an axial bore for receiving an eye bolt, the pin having an intermediate step;

(b) a first flange supported by the step and which, in use, is positioned on one side of the bodywork to be straightened, the pin, in use, passing through a hole in the bodywork;

(c) a second flange supported by the pin and positioned on an opposite side of the bodywork; and (d) means for exerting pressure on said second flange, said means including a sleeve, which carries a positional transverse fixing clip, and an element which is threaded with said pin adjacent said sleeve.

9. The tool of claim 8, wherein said pressure exerting means is disposed at one end of the pin and wherein a knurled band is provided at the other end of the pin.

10. The tool of claim 8, wherein said pressure exerting means is disposed at one end of the pin and wherein the other end of the pin is shaped for engagement by conventional spanners.

11. The tool of claim 8, wherein said second flange includes an outer circumferential rim which, in use, confronts the bodywork to be straightened.

* * * * *